US006502719B2

(12) United States Patent
Huang

(10) Patent No.: US 6,502,719 B2
(45) Date of Patent: Jan. 7, 2003

(54) WASHER SUPPLY DEVICE FOR POWER NAILERS

(75) Inventor: Chen-Fa Huang, Ta Li (TW)

(73) Assignee: Besco Pneumatic Corp., Taichung Hsien (TW)

( * ) Notice: Subject to any disclaimer, the term of this patent is extended or adjusted under 35 U.S.C. 154(b) by 81 days.

(21) Appl. No.: 09/765,567

(22) Filed: Jan. 22, 2001

(65) Prior Publication Data

US 2002/0096536 A1 Jul. 25, 2002

(51) Int. Cl.[7] ..... B65H 1/08

(52) U.S. Cl. ..... 221/227; 221/232; 221/279; 221/312 A

(58) Field of Search ..... 221/226, 227, 221/231, 232, 279, 312 A, 198; 271/117, 118, 120, 119, 135, 136

(56) References Cited

U.S. PATENT DOCUMENTS 2,298,884 A * 10/1942 Hope ..... 221/279
3,282,490 A * 11/1966 Eady ..... 227/120
5,163,580 A * 11/1992 Beach et al. ..... 206/445
6,302,310 B1 * 10/2001 Lamb ..... 221/232

* cited by examiner

*Primary Examiner*—H. Grant Skaggs
(74) *Attorney, Agent, or Firm*—Rosenberg, Klein & Lee

(57) ABSTRACT

A washer supply device includes a retaining tube connected to a side of a power nailer and a slot is defined longitudinally through the retaining tube. A pile of washers are received in the retaining tube. A washer supply device is connected between a lower end of the retaining tube and a nose of the power nailer. A first member is movably received in the tubular tube and a second member is fixedly connected to an inner periphery of the retaining tube. A biasing band is connected between the first member and the second member. A pressing member is connected to the first member and presses the washers by the biasing band.

1 Claim, 5 Drawing Sheets

WASHER SUPPLY DEVICE FOR POWER NAILERS

FIELD OF THE INVENTION

The present invention relates to a washer supply device that employs a pressing member connected with a biasing member to apply a downward force on the piled washers in the retaining tube.

BACKGROUND OF THE INVENTION

A conventional washer supply device 13 for a power nailer is shown in FIG. 1 and generally includes a disk-like box 11 in which washers 10 are received, the box 11 is engaged with the washer supply device 13 on a side of the power nailer 12. A tube 14 is connected between the box 11 and a washer transferring device 15 which is connected to a nose portion 120 of the power nailer 12. The box II and the device 13 are bulky and occupy a large space. Once the washers 10 are jammed in the box 11, the box 11 is to be discarded.

FIG. 2 shows another type of washer supply device comprising a retaining tube 23 connected to a side of the power nailer 12 and a pushing rod 26 extends through the retaining tube 23. A spring 25 is connected to the pushing rod 26 and a pushing end 27 is connected to a lower end of the pushing rod 26. A washer transferring member 24 is connected to a nose 120 of the nailer 12 and a tubular casing 22 is engaged between the retaining tube 23 and the washer transferring member 24. A plurality of washers 21 are piled in the tubular casing 22 and the washers 21 can be transferred to the nose 120 so as to be work with the nails ejected from the nose 120. The washers 21 are pressed downward by the pushing end 26 and the tubular casing 22 is made of stiff material so that when some of the washers 21 are jammed in the tubular casing 22, the tubular casing 22 has to be discarded. The pushing rod 26 extended from the retaining tube 23 and could be inconvenient for the user to using the power nailer 12 in a narrow space. Once the pushing rod 26 is bent, the washers 21 cannot be sent to the washer transferring member 24.

SUMMARY OF THE INVENTION

In accordance with one aspect of the present invention, there is provided a washer supply device and comprises a retaining tube connected to a side of a power nailer and a slot is defined longitudinally through the retaining tube. The retaining tube has an open top and a washer supply device is connected a lower end of the retaining tube. A first member is movably received in the tubular tube and a second member is fixedly connected to an inner periphery of the retaining tube. A first end of a biasing band is fixedly connected to the first member and a second end of the biasing band is fixedly connected to the second member. A pressing member is connected to the first member so as to press the washers in the retaining tube. 'The primary object of the present invention is to provide a washer supply device that has no long pushing rod and no box or tubular casing 22 are required.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
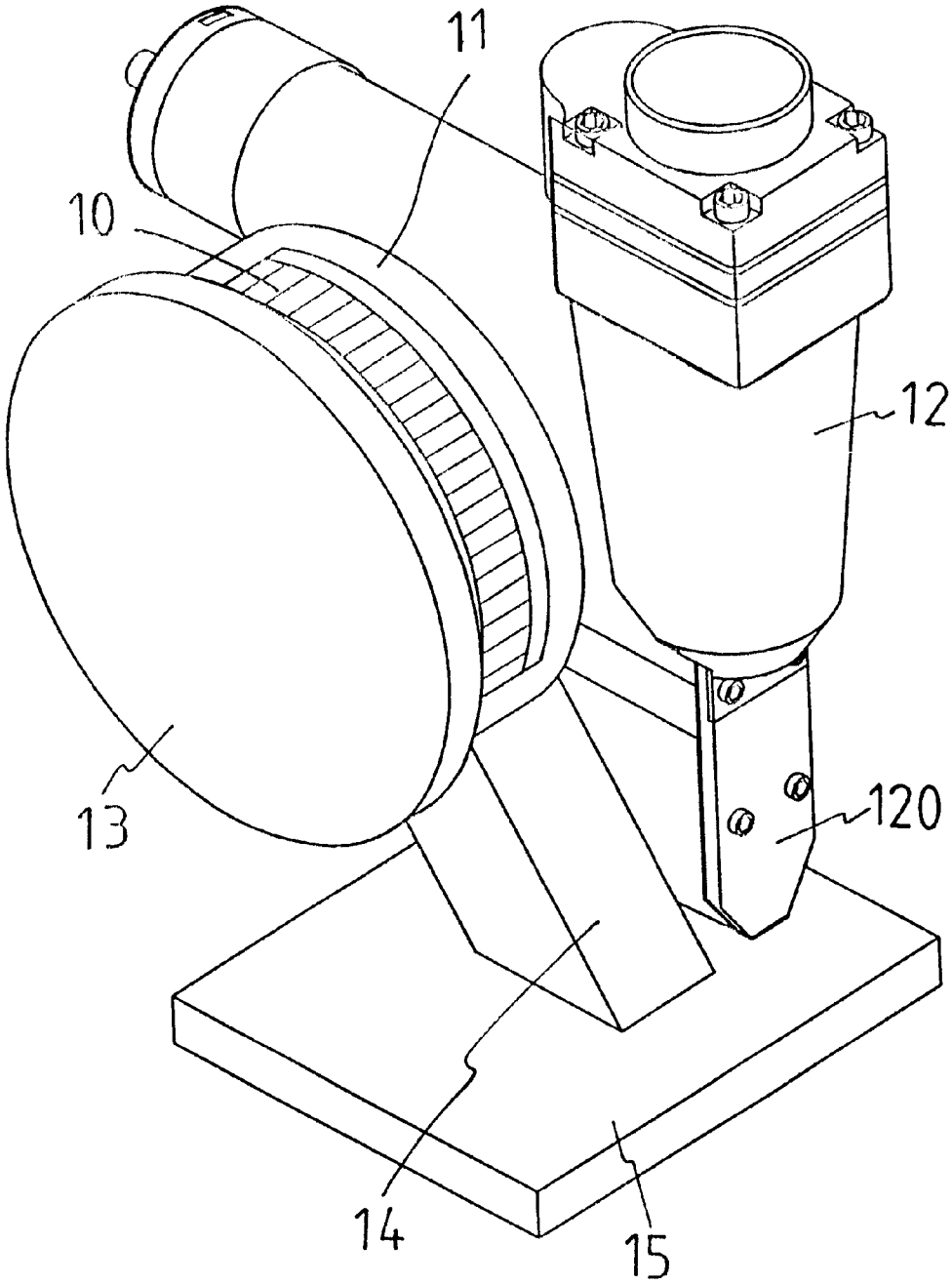
FIG. 1 PRIOR ART
FIG. 1 is a perspective view to show a conventional washer supply device.
Figure 2:
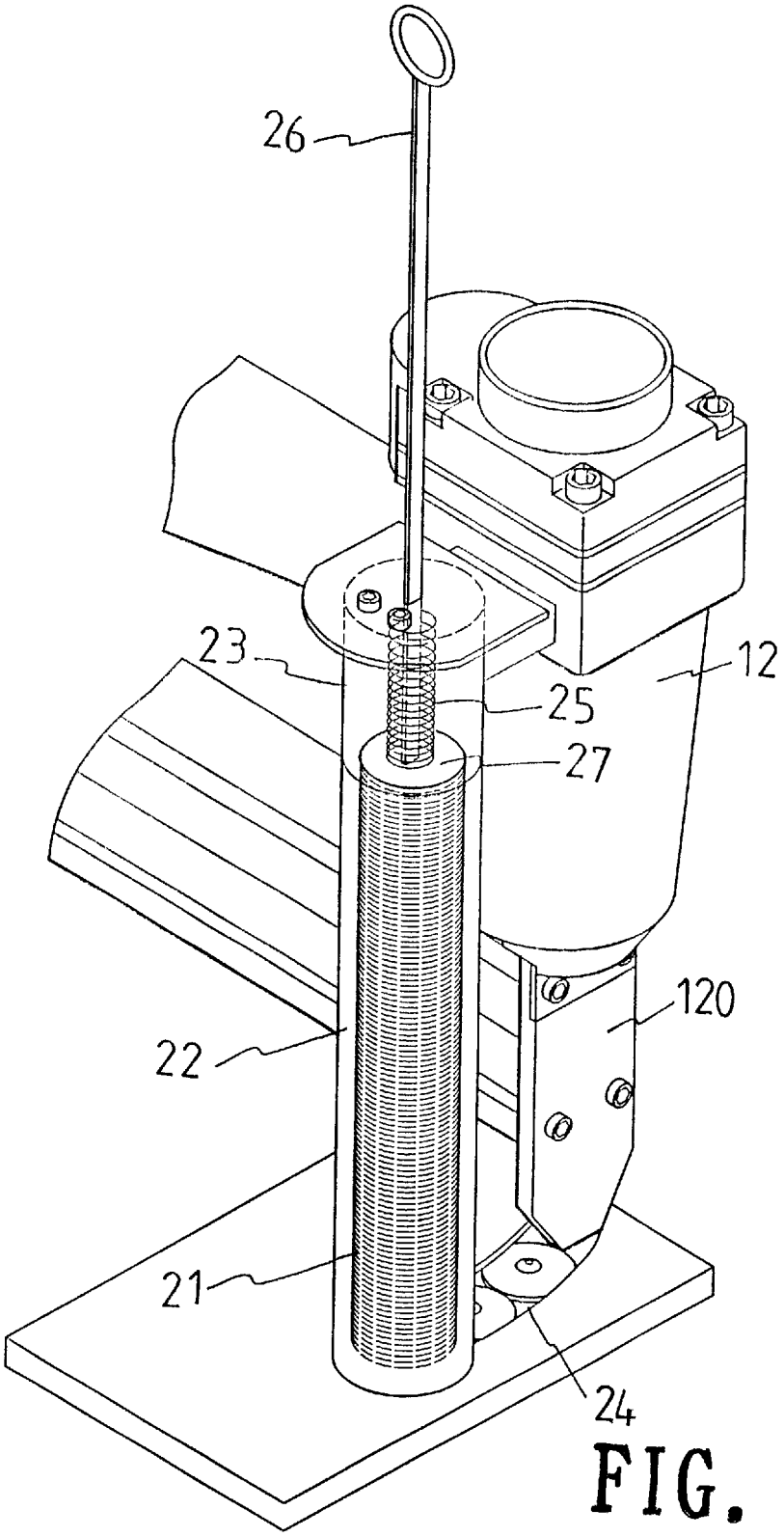
FIG. 2 PRIOR ART
FIG. 2 is a perspective view to show another conventional washer supply device.
Figure 3:
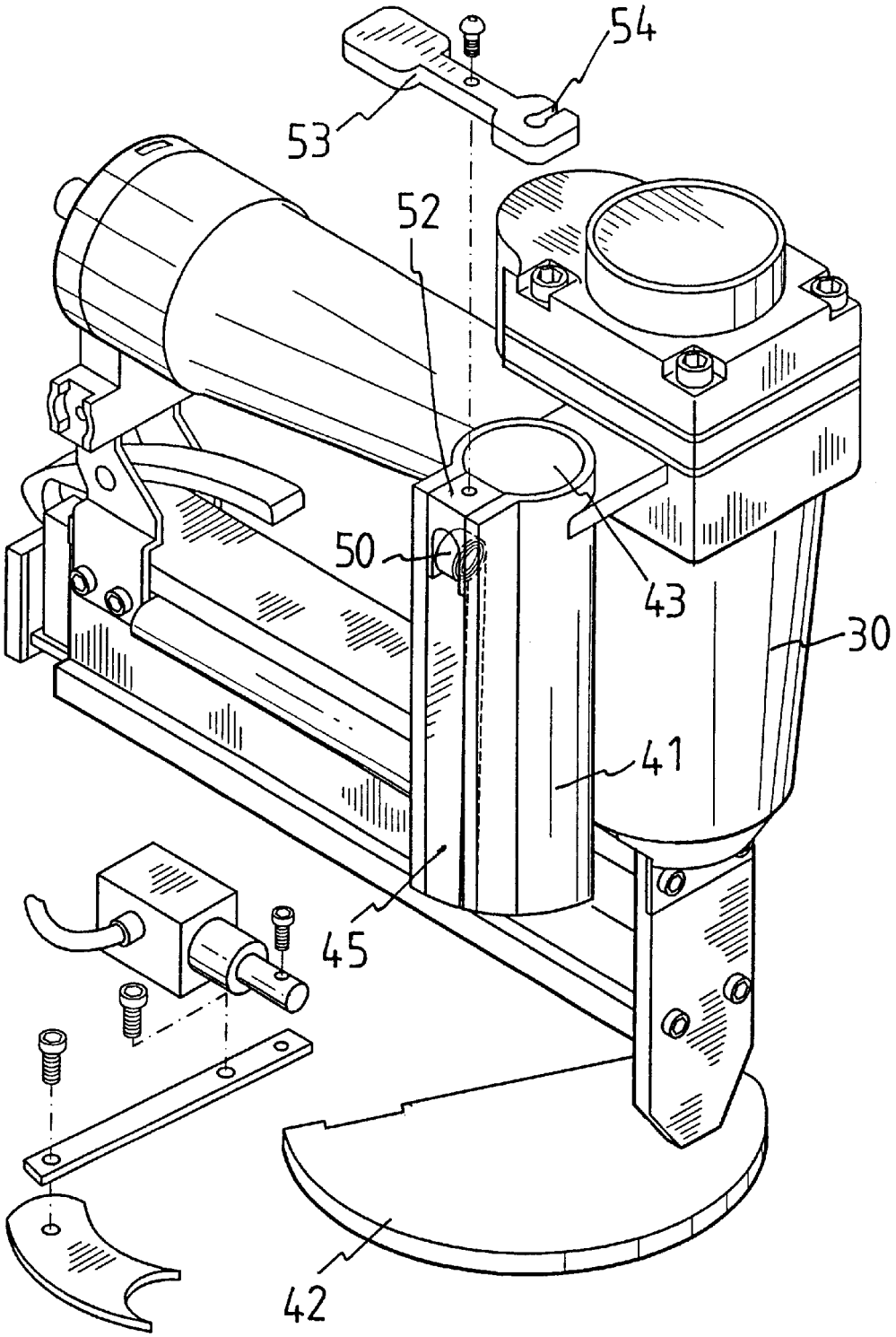
FIG. 3 is an exploded view to show a washer supply device of the present invention.
Figure 4:
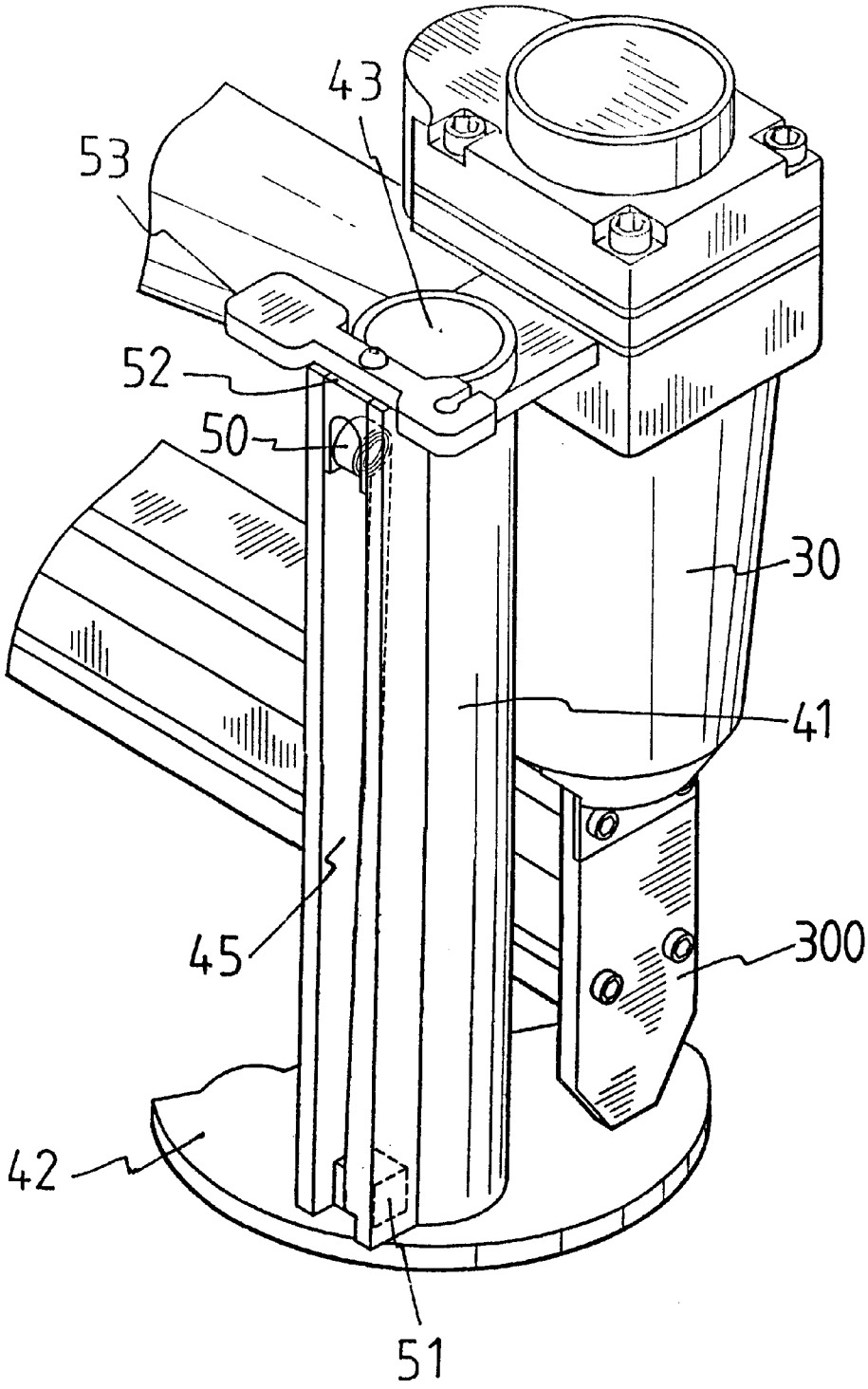
FIG. 4 is a perspective view to show the washer supply device of the present invention.

Referring to FIGS. 3 and 4, the washer supply device for a power nailer 30 of the present invention comprises a retaining tube 41 connected to a side of a power nailer 30 and a slot 45 is defined longitudinally through the retaining tube 41. The retaining tube 41 has an open top 43 and a washer supply device 42 is connected between a lower end of the retaining tube 41 and a nose 300 of the power nailer 30. A first member 52 is movably received in the tubular tube 41 and located at the open top 43. A second member 51 is fixedly connected to an inner periphery of the retaining tube 41 and located on the lower end of the retaining tube 41. A first end of a biasing band 50 is fixedly connected to the first member 52 and wrapped around the first member 52, and a second end of the biasing band 50 is fixedly connected to the second member 51.

A pressing member 53 has a notch 54 defined in a side of a first end of the pressing member 53 and a bolt connects a mediate portion of the pressing member 53 to the first member 52. A width of the pressing member 53 is smaller than a width of the slot 45 so that the pressing member 53 can be rested on the top of the retaining tube 41 as shown in FIG. 4 when no washers are received in the retaining tube 41.

Figure 5:
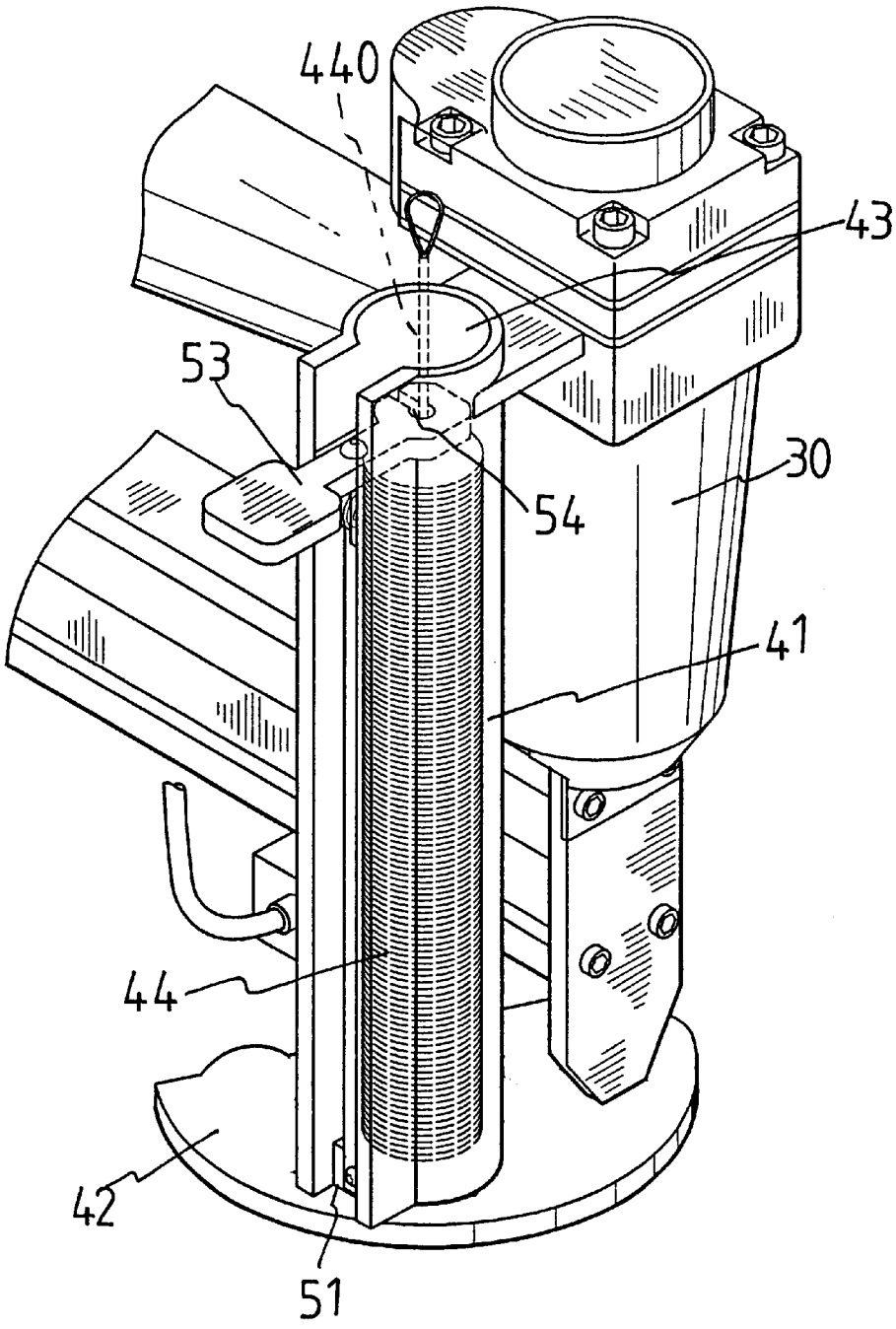
FIG. 5 is a perspective view to show the washer supply device of the present invention wherein washers are received in the retaining tube.

As shown in FIG. 5, the washers 44 are piled up and collected by a wire 440 and the wire 440 is engaged with the notch 54. The pressing member 53 is rotated to let the shank of the pressing member 53 movably inserted in the slot 45 so that the washers 44 are stably pressed in the retaining tube 41.

While we have shown and described various embodiments in accordance with the present invention, it should be clear to those skilled in the art that further embodiments may be made without departing from the scope and spirit of the present invention.

What is claimed is:

1. A washer supply device comprising:

a retaining tube adapted to be connected to a side of a power nailer and a slot defined longitudinally through said retaining tube, said retaining tube having an open top, a washer supply device connected a lower end of said retaining tube;

a first member movably received in said tubular tube and located at said open top, a second member fixedly connected to an inner periphery of said retaining tube and located on said lower end of said retaining tube, a first end of a biasing band fixedly connected to said first member and a second end of said biasing band fixedly connected to said second member, and a pressing member having a notch defined in a side of a first end of said pressing member and a bolt connecting a mediate portion of said pressing member to said first member, a width of said pressing member being smaller than a width of said slot.

* * * * *